US006174653B1

(12) United States Patent
Wildman

(10) Patent No.: US 6,174,653 B1
(45) Date of Patent: Jan. 16, 2001

(54) METHOD FOR RAPID PHOTOGRAPHIC PROCESSING

(75) Inventor: Nigel R. Wildman, Hertfordshire (GB)

(73) Assignee: Eastman Kodak Company, Rochester, NY (US)

( * ) Notice: Under 35 U.S.C. 154(b), the term of this patent shall be extended for 0 days.

(21) Appl. No.: 09/416,825

(22) Filed: Oct. 12, 1999

(30) Foreign Application Priority Data

Oct. 20, 1998 (GB) ..... 9822728

(51) Int. Cl.[7] ..... G03C 7/42
(52) U.S. Cl. ..... 430/393; 430/460
(58) Field of Search ..... 430/393, 460

(56) References Cited

U.S. PATENT DOCUMENTS

| | | | | |
|---|---|---|---|---|
| 4,962,014 | | 10/1990 | Ishikawa et al. | 430/393 |
| 5,582,958 | * | 12/1996 | Buchanan et al. | 430/393 |
| 5,635,341 | * | 6/1997 | Yamashita et al. | 430/393 |
| 5,795,703 | | 8/1998 | Ishikawa . | |
| 6,004,731 | * | 12/1999 | Hayashi et al. | 430/393 |

FOREIGN PATENT DOCUMENTS

| | | |
|---|---|---|
| 308 706 | 3/1989 | (EP) . |
| 482 915 | 4/1992 | (EP) . |
| 871 065 | 10/1998 | (EP) . |
| 6-324448 | 11/1994 | (JP) . |

* cited by examiner

*Primary Examiner*—Hoa Van Le

(57) ABSTRACT

A method of forming a color photographic image comprises: contacting an imagewise exposed color photographic material with a color developing composition to provide a developed material, and contacting the developed material with a bleach-fix composition. This composition is a bleaching agent comprising of a complex of ferric ion and an aminopolycarboxylic acid, a fixing agent; and sulphite ion in an amount up to 0.1 mol/l; said bleach-fix composition having a pH from about 4 to about 8 and said contacting being for a period from about 5 to about 20 seconds.

10 Claims, No Drawings

METHOD FOR RAPID PHOTOGRAPHIC PROCESSING

FIELD OF THE INVENTION

This invention relates to a method of processing colour photographic materials e.g. colour photographic papers in a rapid fashion.

BACKGROUND OF THE INVENTION

Multicolour, multilayer photographic elements are well known in the art. Such materials generally have three different selectively sensitized colour records having one or more silver halide emulsion layers coated on one side of a single support. Each colour record has components useful for forming a particular colour in an image. Typically, the materials utilize colour forming couplers or dyes in the sensitized layers during processing.

One commercially important type of colour photographic elements are what are known as colour prints. These elements are used to display images captured by a camera user on photographic colour negative films. There is continuing interest in the industry to provide colour print images more rapidly so the customers have a shorter wait from the time the colour negative films are submitted for processing to the time they receive the colour prints.

In colour paper processing, the conventional order of the light sensitive colour records on a support is a blue-sensitive silver halide emulsion layer nearest the support, a green-sensitive silver halide emulsion layer next to it, and a red-sensitive silver halide emulsion layer as the topmost light sensitive layer.

The basic image-forming process of colour photography comprises the exposure of a silver halide photographic recording material, such as a paper, to light, and the chemical processing of the material to reveal a useful image. For example, colour negative papers may be exposed by digital means e.g. LED (light emitting diode), laser or CRT (cathode ray tube) in a minilab. The chemical processing involves two fundamental steps. The first is a treatment of the exposed silver halide with a colour developing agent wherein some or all of the silver ion is reduced to metallic silver.

The second is the removal of the silver metal by the individual or combined steps of bleaching and fixing so that only dye remains in the processed material. During bleaching, the developed silver is oxidized to a silver salt by a suitable bleaching agent. During fixing, the oxidized silver is dissolved and removed from the element by a suitable fixing agent.

U.S. Pat. No. 4,962,014 describes a method of processing an exposed colour photographic material comprising the steps of colour developing, bleach-fixing and washing. The bleach-fix solution contains sulphite ion in an amount from 0.08 to 0.30 mol/l. The bleaching agent may be ferric ion complexed with an organic ligand such as ethylenediaminetetraacetic acid (EDTA). The pH of the bleach-fix may be from 4 to 8. The bleaching time is from 30 to 70 seconds.

PROBLEM TO BE SOLVED BY THE INVENTION

As noted above, there is a need to reduce processing time, and particularly to reduce bleach-fixing time.

SUMMARY OF THE INVENTION

The invention provides a method of forming a colour photographic image comprising A) contacting an imagewise exposed colour photographic material with a color developing composition to provide a developed material, and B) contacting the developed material with a bleach-fix composition comprising a bleaching agent comprising a complex of ferric ion and an aminopolycarboxylic acid;

a fixing agent; and sulfite ion in an amount up to 0.1 mol/l; said bleach-fix composition having a pH from about 4 to about 8 and said contacting being for a period from about 5 to about 25 seconds.

ADVANTAGEOUS EFFECT OF THE INVENTION

The method of the invention enables faster processing by reducing the bleach-fixing time. The reduction in bleach-fixing time is achieved without the addition of more iron and hence more ligand (aminopolycarboxylic acid). The reduction in bleach-fixing time is also achieved without lowering the pH which would make the bleach-fix less stable.

DETAILED DESCRIPTION OF THE INVENTION

The bleach-fix composition used in the method of the invention contains a very low concentration of sulphite ion. Surprisingly, the low sulphite ion concentration enables an increased rate of bleaching by the bleaching agent.

The amount of sulphite ion used is up to 0.1 mol/l and preferably less than 0.08 mol/l. The amount of sulphite ion used may be from about 0.01 to about 0.079 mol/l, more preferably from about 0.05 to about 0.079 mol/l.

Ferric complexes of aminopolycarboxylic acids are well known bleaching agents. Specific examples of such bleaching agents are provided in *Research Disclosure,* publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred examples of such aminopolycarboxylic acids are alkylenediaminetetraacetic acids and alkylenediaminedisuccinic acids. Specific examples include ethylenediaminetetraacetic acid (EDTA) and ethylenediaminedisuccinic acid (EDDS).

The bleaching agent is preferably used in an amount from about 0.1 to about 0.4 mol/l, more preferably from about 0.15 to about 0.3 mol/l. It is generally convenient for the ferric complex to be formed in situ in the bleach-fix solution by reaction of a ferric salt, such as ferric sulfate or ferric nitrate, with a ligand as described herein.

The method of the invention allows the bleach-fixing to occur faster without having to lower the pH of the composition. The pH may be from about 4 to about 8, preferably from about 5.5 to about 6.5.

The time taken for the bleach-fixing step is from about 5 to about 25 seconds, preferably from about 9 to about 20 seconds. The time varies depending on factors such as silver laydown and gel laydown.

The temperature at which the bleach-fixing is carried may be from 30 to 50° C., preferably from 35 to 42° C.

The low level of sulphite ion can result in the stability of the bleach-fix composition being reduced. It has been found unexpectedly that the addition of sulphosuccinic acid or a salt thereof will stabilize the bleach-fix without increasing the bleach-fix time. Thus rapid bleach-fixing is achieved and the solution has good longevity.

The sulphosuccinic acid or salt thereof may be employed in an amount from about 0.1 to about 0.4 mol/l, preferably from about 0.15 to about 0.3 mol/l.

The bleach-fix composition comprises a fixing agent. Fixing agents are water-soluble solvents for silver halide such as a thiosulphate (e.g., sodium thiosulphate, ammonium thiosulphate, and potassium thiosulphate), a thiocyanate (e.g., sodium thiocyanate, potassium thiocyanate and ammonium thiocyanate), a thioether compound (e.g., ethylenebisthioglycolic acid and 3,6-dithia-1,8-octanediol), a thioglycolic acid or a thiourea, an organic thiol, an organic phosphine, a high concentration of halide, such as bromide or iodide, a mesoionic thiolate compound, and sulphite. These fixing agents can be used singly or in combination. Thiosulphate is preferably used and ammonium thiosulphate, in particular, is used most commonly owing to the high solubility. Alternative counter-ions such as potassium, sodium, lithium, cesium as well as mixtures of two or more cations may be used.

Further details of such materials are provided in *Research Disclosure* noted above.

The fixing agent may be present in an amount from about 0.34 to about 1.5 mol/l, preferably from about 0.47 to about 1.15 mol/l.

The bleach-fix composition may also comprise other addenda such as buffers, anti-scumming agents, antioxidants, anti-foam agents and preservatives.

The color developing compositions useful in the practice of this invention include one or more color developing agents that are well known in the art that, in oxidized form, will react with dye forming color couplers in the processed materials. Such color developing agents include, but are not limited to, aminophenols, p-phenylenediamines (especially N,N -dialkyl-p-phenylenediamines) and others which are well known in the art, such as EP 0 434 097A1 and EP 0 530 921A1. It may be useful for the color developing agents to have one or more water-solubilizing groups as are known in the art.

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-b-hydroxyethylamino)- 2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylene-diamine sesquisulfate, and others readily apparent to one skilled in the art.

A wide variety of types of photographic materials, especially papers containing various types of emulsions can be processed using the present invention, the types of elements being well known in the art (see *Research Disclosure,* noted above). In particular, the invention can be used to process color photographic papers of all types of emulsions including so-called "high chloride" and "low chloride" type emulsions, and so-called tabular grain emulsions as well.

The present invention is particularly useful to process high chloride (greater than 70 mole % chloride and preferably greater than 90 mole % chloride, based on total silver) emulsions in color photographic papers in a rapid fashion. Such color photographic papers can have any useful amount of silver coated in the one or more emulsions layers, and in some embodiments, low silver (that is, less than about 0.8 g silver/$m^2$, and preferably less than 0.6 g silver/$m^2$) elements are processed with the present invention. The layers of the photographic elements can have any useful binder material or vehicle as it known in the art, including various gelatins and other colloidal materials.

Color development of an imagewise exposed photographic silver halide paper is carried out by contacting the element with a color developing composition to produce the desired color image.

In the method of the invention, colour development is followed by a bleach-fixing step.

Additional processing steps can be carried out using conventional procedures, including but not limited to, one or more development stop, bleaching, fixing, bleach/fixing, washing (or rinsing) and drying steps, in any particular desired order as would be known in the art. Useful processing steps, conditions and materials useful therefore are well known for the various processing protocols steps (other than the bleach fixing step used in the invention) including the conventional Process RA-4 (see for example, *Research Disclosure,* noted above, and the references noted therein, and U.S. Pat. No. 4,892,804, also noted above).

The photographic papers processed in the practice of this invention are preferably multilayer color elements that typically contain dye image-forming color records sensitive to each of the three primary regions of the visible spectrum. Each color record can be comprised of a single emulsion layer or multiple emulsion layers sensitive to a given region of the spectrum. The color records of the element can be arranged in any of the various orders known in the art. The elements can also contain other conventional layers such as filter layers, interlayers, subbing layers, overcoats and other layers readily apparent to one skilled in the art. A magnetic backing can be included on the backside of conventional supports.

Considerably more details of the color paper structure and components are described in *Research Disclosure,* noted above. Included within such teachings in the art is the use of various classes of cyan, yellow and magenta color couplers that can be used with the present invention (including pyrazolone type magenta dye forming couplers). Such papers generally have pigmented resin-coated paper supports which are prepared with the usual internal and external sizing agents (including alkylketene dimers and higher fatty acids), strengthening agents and other known paper additives and coatings.

The color developing compositions described herein can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein.

The processing time and temperature used for each processing step (except bleach-fixing) of the present invention are generally those conventionally used in the art.

The following examples are provided to illustrate the present invention, but the invention is not to be interpreted as so limited. Unless otherwise indicated, percentages are by weight.

EXAMPLE 1

Samples of KODAK EKTACOLOR EDGE 7 Colour Paper (Paper 1) having a silver laydown of 470 g/m$^2$ and a multilayer colour photographic paper similar to KODAK EKTACOLOR EDGE 7 Colour Paper but having a silver laydown of 600 g/m$^2$ (Paper 2) were fogged and developed to Dmax using EKTACOLOR RA Prime developer for 45 seconds at 38° C. These samples were then bleach-fixed in the test solutions and the IR density measured at 950 nm to detect the removal of silver. The clear time was taken as the time from introducing the sample to the bleach-fix composition (blix) until no further change in IR density attenuation was measured. The attached Table 1 shows the results that were obtained.

TABLE 1

| Bleach-fix agent | Sulphite Hypo M | Sulphite M | pH | Clear times (seconds) Paper 1 | Clear times (seconds) Paper 2 | |
|---|---|---|---|---|---|---|
| Fe(NH$_4$)EDTA | 0.78 | 0.22 | 5.5 | 17.5 | 17.5 | Comparison |
| Fe(NH$_4$)EDTA | 0.78 | 0.22 | 6.5 | 21 | 16 | Comparison |
| Fe(NH$_4$)EDTA | 0.78 | 0.07 | 5.5 | 13.5 | 17 | Invention |
| Fe(NH$_4$)EDTA | 0.78 | 0.07 | 6.5 | 17.5 | 12.5 | Invention |
| Fe(NH$_4$)EDTA | 1.35 | 0.22 | 5.5 | 21 | 16.5 | Comparison |
| Fe(NH$_4$)EDTA | 1.35 | 0.22 | 6.5 | 31.5 | 24 | Comparison |
| Fe(NH$_4$)EDTA | 1.35 | 0.07 | 5.5 | 17.5 | 13.8 | Invention |
| Fe(NH$_4$)EDTA | 1.35 | 0.07 | 6.5 | 24 | 20 | Invention |

| Bleach-fix agent | Sulphite Hypo M | Sulphite M | pH | Paper | Average clear time (s) | |
|---|---|---|---|---|---|---|
| Fe(NH$_4$)EDTA | 0.6 | 0.07 | 5.5 | 2 | 13.5 | Invention |
| Fe(NH$_4$)EDTA | 0.6 | 0.07 | 5.5 | 2 | 13.5 | Invention(S) |
| Fe(NH$_4$)EDTA | 0.6 | 0.07 | 5.5 | 1 | 12.5 | Invention |
| Fe(NH$_4$)EDTA | 0.6 | 0.07 | 5.5 | 1 | 12.5 | Invention(S) |
| Fe(NH$_4$)EDTA | 0.6 | 0.07 | 6 | 2 | 14.5 | Invention |
| Fe(NH$_4$)EDTA | 0.6 | 0.07 | 6 | 2 | 15.5 | Invention(S) |
| Fe(NH$_4$)EDTA | 0.6 | 0.07 | 6 | 1 | 14 | Invention |
| Fe(NH$_4$)EDTA | 0.6 | 0.07 | 6 | 1 | 14 | Invention(S) |
| Fe(NH$_4$)EDTA | 0.6 | 0.04 | 6 | 2 | 13.5 | Invention |
| Fe(NH$_4$)EDTA | 0.6 | 0.04 | 6 | 2 | 15.5 | Invention(S) |
| Fe(NH$_4$)EDTA | 0.6 | 0.04 | 6 | 1 | 11 | Invention |
| Fe(NH$_4$)EDTA | 0.6 | 0.04 | 6 | 1 | 12.5 | Invention(S) |

| Bleach-fix agent | Fe M | Paper | pH | Average clear time(s) | Seasoned average clear time(s) | |
|---|---|---|---|---|---|---|
| Fe(NH$_4$)EDTA | 0.25 | 2 | 6 | 14 | 14.5 | Invention |
| Fe(NH$_4$)EDTA | 0.3 | 2 | 6 | 13.5 | 13 | Invention |
| Fe(NH$_4$)EDTA | 0.35 | 2 | 6 | 12.5 | 11 | Invention |
| Fe(NH$_4$)EDTA | 0.25 | 1 | 6 | 11.5 | 13 | Invention |
| Fe(NH$_4$)EDTA | 0.3 | 1 | 6 | 11.5 | 11.5 | Invention |
| Fe(NH$_4$)EDTA | 0.35 | 1 | 6 | 10 | 12.5 | Invention |

In the above Table, "(S)" means 7.26 g/1 Ag+ion was added to the bleach-fix to simulate seasoned conditions The results show significantly improved clear times when the lower level of sulphite was used. The sulphite was present as ammonium or sodium sulphite.

EXAMPLE 2

The experimental procedure of Example 1 was performed with sodium sulphite as the source of sulphite ion. At the low concentrations of sulphite, sodium ion does not inhibit bleach-fixing up to 0.1 M by the results presented in Table 2.

TABLE 2

| Experiment no. | $Na_2SO_3$ conc, M | Paper | Mean Clear time (s) |
|---|---|---|---|
| 1 | 0 | 1 | 10 |
| 2 | 0.02 | 1 | 9 |
| 3 | 0.04 | 1 | 10 |
| 4 | 0.06 | 1 | 10 |
| 5 | 0.08 | 1 | 10 |
| 6 | 0.1 | 1 | 9 |
| 1 | 0 | 2 | 12 |
| 2 | 0.02 | 2 | 11 |
| 3 | 0.04 | 2 | 11.5 |
| 4 | 0.06 | 2 | 12.5 |

TABLE 2-continued

| Experiment no. | $Na_2SO_3$ conc, M | Paper | Mean Clear time (s) |
|---|---|---|---|
| 5 | 0.08 | 2 | 12.5 |
| 6 | 0.1 | 2 | 12 |

EXAMPLE 3

A bleach-fix composition having the following formula was prepared 0.3M Fe as Fe(NH$_4$)EDTA 0.60M ammonium thiosulphate 0.058M sulphite pH 6.0

The following types of sample were prepared by the addition or not of stabilizer to the above formula 1. No addition
2. 0.1 M sulfosuccinic acid
3. 0.2M sulphite Each type of sample was divided in half. Using the procedure given in Example 1, half of each type of sample was measured for Paper 2 clear time at time zero, the other half of each type of sample was kept for 13 days in an unsealed glass bottle. After 13 days the clear times of the other halves were measured (after 10 mins aeration) and the pH of the bleach-fix measured. The next day each pH was corrected to pH 6.0 and the clear time was re-measured. The results are shown in Table 3.

TABLE 3

| Stabiliser | Average at time = 0 | Average at time = 13 days | Average after 14 days with pH adjusted | pH after 13 days |
|---|---|---|---|---|
| None | 12 | 14 | 14.5 | 6.62 |
| Sulfosuccinic acid | 12 | 13 | 11.5 | 6.47 |
| Extra 0.2M sulphite | 13 | 16.5 | 15 | 6.55 |

It can be seen from the clear time (seconds) and pH results that sulfosuccinic acid is the preferred stabiliser.

EXAMPLE 4

To the basic bleach-fix composition of the formula given in Example 3 sulfosuccinic acid was added at different concentrations to provide a range of samples. Using the procedure given in Example 1, clear times were determined for Paper 2 by IR density attenuation at 950 nm at 38° C. The results are shown in Table 4.

TABLE 4

| Acid concentration mol dm-3 | Mean clear time (s) |
|---|---|
| 0 | 11.5 |
| 0.05 | 12 |
| 0.1 | 12 |
| 0.15 | 12 |
| 0.2 | 12.5 |
| 0.25 | 14 |
| 0.3 | 15.5 |

Clear times are not effected below 0.2 Molar sulfosuccinic acid

EXAMPLE 5

This example illustrates the effect of sulphite on EDDS (ethylenediaminedisuccinnic acid) blixes.

Samples of KODAK EKTACOLOR EDGE 7 Colour Paper (Ag laydown=470 g/m$^2$) and Paper 2 (Ag laydown= 600 g/m$^2$) were fogged and developed to Dmax using RA Prime developer for 45 seconds at 38° C. These samples were then bleach-fixed in the test solutions and the IR density measured at 950 nm to detect the removal of silver. The clear time was taken as the time from introducing the sample to the blix until no further change in IR density attenuation was measured. The attached Table 5 shows the results that were obtained.

TABLE 5

| | 1 | 2 | 3 | 4 |
|---|---|---|---|---|
| FeNH4EDDS (M) | 0.2 | 0.2 | 0.2 | 0.2 |
| Sulphite (M) | 0.22 | 0.22 | 0.07 | 0.07 |
| Hypo (M) | 0.6 | 0.6 | 0.6 | 0.6 |
| pH @ 25° C. | 5.5 | 6.5 | 5.5 | 6.5 |
| Clear time for Paper 1 (s) | 16 | 17 | 14.5 | 14 |
| Clear time for Paper 2 (s) | 17.5 | 23 | 17 | 17.5 |

It can be seen that comparing 1 and 3 at pH 5.5 that small differences are seen as the sulphite concentration is reduced. Larger differences can be seen if the pH is raised to 6.5, a more reasonable pH to operate a bleach-fix without leuco cyan dye formation occurring.

The invention has been described in detail with particular reference to preferred embodiments thereof, but it will be understood that variations and modifications can be effected within the spirit and scope of the invention.

What is claimed is:

1. A method of forming a colour photographic image comprising

A) contacting an imagewise exposed colour photographic material with a color developing composition to provide a developed material, and B) contacting the developed material with a bleach-fix composition comprising a bleaching agent comprising a complex of ferric ion and an aminopolycarboxylic acid;

a fixing agent;

a bleach-fix stabiliser comprising sulfosuccinic acid or a salt thereof; and sulphite ion in an amount up to 0.1 mol/l; said bleach-fix composition having a pH from 4 to 8 and said contacting being for a period from 5 to 25 seconds.

2. The method of claim 1 wherein said sulphite ion is present in an amount from about 0.01 to about 0.079 mol/l.

3. The method of claim 1 wherein said bleaching agent comprises a complex of ferric ion and an alkylenediaminetetracetic acid or an alkylenediaminedisuccinic acid.

4. The method of claim 3 wherein said bleaching agent comprises a complex of ferric ion and ethylenediaminetetracetic acid or ethylenediaminedisuccinic acid.

5. The method of claim 1 wherein said bleaching agent is present in an amount from about 0.1 to about 0.4 mol/l.

6. The method of claim 1 wherein said bleach-fix composition has a pH from about 5.5 to about 6.5.

7. The method of claim 1 wherein said contacting is for a period from about 5 to about 20 seconds.

8. A method according to claim 1 wherein the sulfosuccinic acid or salt thereof is present in an amount from 0.1 to 0.4 mol/l.

9. The method of claim 1 wherein said colour photographic material is a colour photographic paper.

10. The method of claim 1 wherein said colour photographic material has been exposed by digital means.

* * * * *